US007258579B2

(12) United States Patent
Nam

(10) Patent No.: US 7,258,579 B2
(45) Date of Patent: Aug. 21, 2007

(54) EXTERNAL COMMUNICATION JACK FOR MOBILE TERMINAL

(75) Inventor: Sang-Eun Nam, Gyeonggi-Do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/325,879

(22) Filed: Dec. 30, 2005

(65) Prior Publication Data

US 2006/0148324 A1 Jul. 6, 2006

(30) Foreign Application Priority Data

Dec. 31, 2004 (KR) ..... 10-2004-0118447

(51) Int. Cl.
*H01R 24/04* (2006.01)

(52) U.S. Cl. ..... 439/668

(58) Field of Classification Search ..... 439/668, 439/669, 607–610, 578–585, 125–128
See application file for complete search history.

(56) References Cited

U.S. PATENT DOCUMENTS 4,671,586 A * 6/1987 DeBolt ..... 439/126

* cited by examiner

*Primary Examiner*—Gary F. Paumen
(74) *Attorney, Agent, or Firm*—Lee, Hong, Degerman, Kang & Schmadeka

(57) ABSTRACT

The present invention relates to an external communication jack for a mobile terminal that prevents damage caused by rotation of a plug inserted therein. The external communication jack comprises a body having an insertion passage for accepting a plug, a terminal mounting part formed on the body for mounting the plug, a connection terminal formed at an outer surface of the terminal mounting part and operatively coupled to circuitry for operating the mobile terminal, and a rotation preventing part formed on at least one of an outer surface of the terminal mounting part and an inner surface of the connection terminal, wherein the rotation preventing part at least partially prevents rotation of the connection terminal with respect to the terminal mounting part.

20 Claims, 8 Drawing Sheets

EXTERNAL COMMUNICATION JACK FOR MOBILE TERMINAL

CROSS-REFERENCE TO RELATED APPLICATIONS

Pursuant to 35 U.S.C. § 119(a), this application claims the benefit of earlier filing date and right of priority to Korean Application No. 2004-118447, filed on Dec. 31, 2004, the contents of which is hereby incorporated by reference herein in its entirety.

FIELD OF THE INVENTION

The present invention relates to an external communication jack for a mobile terminal and, more particularly, to an external communication jack that prevents damage caused by rotation of a plug inserted therein.

BACKGROUND OF THE INVENTION

FIG. 1 is an exploded perspective view of an external communication jack of a mobile terminal in accordance with the related art. FIG. 2 is a sectional view illustrating a state where a plug of an earphone is insertedly positioned in the external communication jack in accordance with the related art.

The related art external communication jack 110 includes a body 106 mounted in a printed circuit board (PCB) 102 of a mobile terminal and an insertion passage 108 formed at its central portion, into which a plug 104 of an earphone is inserted. Platy connection terminals 120*a*, 120*b* and 120*c* are mounted at certain intervals in the insertion passage 108 of the body 106, which are soldered to the PCB 102 so as to be electrically operational with a bar-type connection part 138 of the plug 104. An annular connection terminal 122 is mounted at a front side of the body 106, into which an annular connection part 130 of the plug 104 is inserted.

The plug 104 of the earphone includes a plug body 132 to which a wire is connected. First, second and third connection portions 134*a*, 134*b* and 134*c*, respectively, extend from the plug body 132 and are sequentially formed at certain intervals with an insulation layer 136 positioned as a boundary therebetween. The annular connection part 130 is mounted at the plug body 132 and formed in a ring shape with a certain interval at an outer circumferential surface of the bar-type connection part 138.

The platy connection terminals 120*a*, 120*b* and 120*c* which contact the bar-type connection part 138 in the insertion passage 108 are sequentially mounted at the body 106, and a cylindrical terminal mounting part 140 is formed at the front side of the body 106, on which the annular connection terminal 122 is mounted.

The first connection terminal 120*a* elastically contacts the first connection portion 134*a*. The second connection terminal 120*b* is disposed at a certain distance from the first connection terminal 120*a* and contacts the second connection portion 134*b*. The third connection terminal 120*c* is disposed at a certain distance from the second connection terminal 120*b* and contacts the third connection portion 134*c*.

The annular connection terminal 122 is formed at the outer circumference of the terminal mounting part 140. A connection plate 142 for transmitting an electrical signal is integrally connected to the PCB 102 by soldering or the like. Specifically, the connection plate 142 is formed as a thin plate type, integrally extends from a rear side of the annular connection terminal 122, is fixed to the body 106, and is connected to the PCB 102 by soldering or the like.

When the plug 104 is mounted to the conventional external communication jack 110, the bar-type connection part 138 of the plug 104 is inserted into the insertion passage 108 and the annular connection part 130 is mounted at the outer circumference of the annular connection terminal 122.

Moreover, the first connection portion 134*a* of the bar-type connection part 138 contacts the first connection terminal 120*a* mounted inside the insertion passage 108, the second connection portion 134*b* contacts the second connection terminal 120*b*, and the third connection portion 134*c* contacts the third connection terminal 120*c*. As stated above, the annular connection part 130 is mounted at the outer circumferential surface of the annular connection terminal 122. Thus, an electrical signal of the mobile terminal can be transmitted to the earphone or an electrical signal of the earphone can be transmitted to the mobile terminal.

However, the related art external communication jack has the following problems.

In a state where the plug 104 is mounted in the external communication jack 110, when the plug 104 is rotated by a user, the annular connection part 130 positioned at the annular connection terminal 122 will also be rotated. Accordingly, a rotational moment is generated at the annular connection terminal 122. This is problematic because a connection portion between the annular connection terminal 122 and the connection plate 142 can be damaged as a result of the generated rotational moment. Moreover, the soldered portion between the connection plate 142 and the PCB 102 can be damaged.

Specifically, when the plug 104 is rotated while being insertedly positioned in the external communication jack 110, because the annular connection part 130 of the plug 104 is elastically installed at the annular connection terminal 122, the rotational force of a rotated annular connection part 130 is transferred to the annular connection terminal 122 to continuously generate a rotational moment at the annular connection terminal 122. This damages a portion between the annular connection terminal 122 and the connection plate 142 and may further damage a soldered portion between the PCB 102 and the connection plate 142.

SUMMARY OF THE INVENTION

Therefore, an object of the present invention is to provide an external communication jack free from damage in spite of rotation of a plug inserted therein by mutually locking a body and an annular connection terminal to prevent the generation of a rotational moment at the annular connection terminal.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the present invention is embodied in an external communication jack for a terminal, the external communication jack comprising a body having an insertion passage for accepting a plug, a terminal mounting part formed on the body for mounting the plug, a connection terminal formed at an outer surface of the terminal mounting part and operatively coupled to circuitry for operating the terminal, and a rotation preventing part formed on an outer surface of the terminal mounting part and an inner surface of the connection terminal, wherein the rotation preventing part at least partially prevents rotation of the connection terminal with respect to the terminal mounting part.

Preferably, the rotation preventing part comprises a first rotation preventing part formed on the outer surface of the terminal mounting part and a second rotation preventing part formed on the inner surface of the connection terminal, wherein the first rotation preventing part and the second rotation preventing part engage one another to prevent rotation of the connection terminal with respect to the terminal mounting part.

In one aspect of the invention, the first rotation preventing part is a locking rib protruding from an outer surface of the terminal mounting part and the second rotation preventing part is a locking protrusion protruding from an inner surface of the connection terminal, wherein the locking rib operatively engages the locking protrusion to prevent rotation of the connection terminal.

In another aspect of the invention, the first rotation preventing part is a locking rib protruding from an outer surface of the terminal mounting part and the second rotation preventing part is a pair of locking protrusions protruding from an inner surface of the connection terminal, wherein the locking rib operatively engages either of the pair of locking protrusions to prevent rotation of the connection terminal in at least one of a clockwise and counterclockwise direction.

In a further aspect of the invention, the first rotation preventing part is a pair of locking ribs protruding from an outer surface of the terminal mounting part and the second rotation preventing part is a locking protrusion protruding from an inner surface of the connection terminal, wherein each of the pair of locking ribs operatively engages the locking protrusion respectively to prevent rotation of the connection terminal in at least one a clockwise and counterclockwise direction.

In yet another aspect of the invention, the first rotation preventing part is a locking rib protruding from an outer surface of the terminal mounting part and the second rotation preventing part is a locking recess formed in an inner surface of the connection terminal, wherein the locking rib inserts into the locking recess to prevent rotation of the connection terminal.

Preferably, the external communication jack further comprises a release preventing unit operating between the connection terminal and the terminal mounting part for preventing axial movement of the connection terminal with respect to the terminal mounting part. Preferably, the release preventing unit comprises a locking groove formed in a rotational direction on an outer surface of the terminal mounting part and a locking protrusion protruding from an inner surface of the connection terminal, wherein the locking protrusion operatively engages the locking groove to prevent the axial movement of the connection terminal.

Preferably, the locking groove is formed by two protrusion portions formed in a rotational direction on the outer surface of the terminal mounting part and having a certain distance therebetween.

Preferably, the insertion passage houses at least one connection terminal for contacting a connection part of the plug.

In accordance with another embodiment of the present invention, an external communication jack for a terminal comprises a body having an insertion passage for accepting a plug, a terminal mounting part formed on the body for mounting the plug, a connection terminal formed at an outer surface of the terminal mounting part and operatively coupled to circuitry for operating the terminal, and a rotation preventing part formed on the body and the connection terminal for at least partially preventing rotation of the connection terminal with respect to the terminal mounting part.

In one aspect of the invention, the rotation preventing part comprises a stopping protrusion extending from a rear side of the connection terminal, and a stopping recess formed in a longitudinal direction at the body, wherein the stopping protrusion is operatively inserted into the stopping protrusion to prevent rotation of the connection terminal.

In accordance with another embodiment of the present invention, a mobile terminal for accepting a plug comprises a main body, circuitry housed within the main body for operating the mobile terminal, and an external communication jack operatively connected to the circuitry, wherein the external communication jack comprises a body having an insertion passage for accepting the plug, a terminal mounting part formed on the body for mounting the plug, a connection terminal formed at an outer surface of the terminal mounting part and operatively coupled to the circuitry for operating the mobile terminal, and a rotation preventing part formed on at least one of an outer surface of the terminal mounting part and an inner surface of the connection terminal, wherein the rotation preventing part prevents rotation of the connection terminal with respect to the terminal mounting part.

Preferably, the rotation preventing part comprises a first rotation preventing part formed on the outer surface of the terminal mounting part and a second rotation preventing part formed on the inner surface of the connection terminal, wherein the first rotation preventing part and the second rotation preventing part engage one another to prevent rotation of the connection terminal with respect to the terminal mounting part.

In one aspect of the invention, the first rotation preventing part is a locking rib protruding from an outer surface of the terminal mounting part and the second rotation preventing part is a locking protrusion protruding from an inner surface of the connection terminal, wherein the locking rib operatively engages the locking protrusion to prevent rotation of the connection terminal.

In another aspect of the invention, the first rotation preventing part is a locking rib protruding from an outer surface of the terminal mounting part and the second rotation preventing part is a pair of locking protrusions protruding from an inner surface of the connection terminal, wherein the locking rib operatively engages either of the pair of locking protrusions to prevent rotation of the connection terminal in at least one of a clockwise and counterclockwise direction.

In a further aspect of the invention, the first rotation preventing part is a pair of locking ribs protruding from an outer surface of the terminal mounting part and the second rotation preventing part is a locking protrusion protruding from an inner surface of the connection terminal, wherein each of the pair of locking ribs operatively engages the locking protrusion respectively to prevent rotation of the connection terminal in at least one a clockwise and counterclockwise direction.

In yet another aspect of the invention, the first rotation preventing part is a locking rib protruding from an outer surface of the terminal mounting part and the second rotation preventing part is a locking recess formed in an inner surface of the connection terminal, wherein the locking rib inserts into the locking recess to prevent rotation of the connection terminal.

Preferably, the external communication jack further comprises a release preventing unit operating between the connection terminal and the terminal mounting part for preventing axial movement of the connection terminal with respect to the terminal mounting part.

Preferably, the release preventing unit comprises a locking groove formed in a rotational direction on an outer surface of the terminal mounting part and a locking protrusion protruding from an inner surface of the connection terminal, wherein the locking protrusion operatively engages the locking groove to prevent the axial movement of the connection terminal.

Preferably, the locking groove is formed by two protrusion portions formed in a rotational direction on the outer surface of the terminal mounting part and having a certain distance therebetween.

Preferably, the insertion passage houses at least one connection terminal for contacting a connection part of the plug.

In accordance with another embodiment of the present invention, a mobile terminal for accepting a plug comprises a main body, circuitry housed within the main body for operating the mobile terminal, and an external communication jack operatively connected to the circuitry, wherein the external communication jack comprises a body having an insertion passage for accepting the plug, a terminal mounting part formed on the body for mounting the plug, a connection terminal formed at an outer surface of the terminal mounting part and operatively coupled to the circuitry for operating the mobile terminal, and a rotation preventing part formed on the body and the connection terminal for at least partially preventing rotation of the connection terminal with respect to the terminal mounting part.

In one aspect of the invention, the rotation preventing part comprises a stopping protrusion extending from a rear side of the connection terminal and a stopping recess formed in a longitudinal direction at the body, wherein the stopping protrusion is operatively inserted into the stopping protrusion to prevent rotation of the connection terminal.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE PREFERRED EMBODIMENTS

The present invention relates to an external communication jack for a mobile terminal, wherein the external communication jack prevents damage caused by rotation of a plug inserted therein.

An external communication jack for a mobile terminal in accordance with the present invention will now be described with reference to the accompanying drawings. There can be several embodiments of the external communication jack for the mobile terminal in accordance with the present invention, of which the most preferred embodiments will be described.

Figure 1:
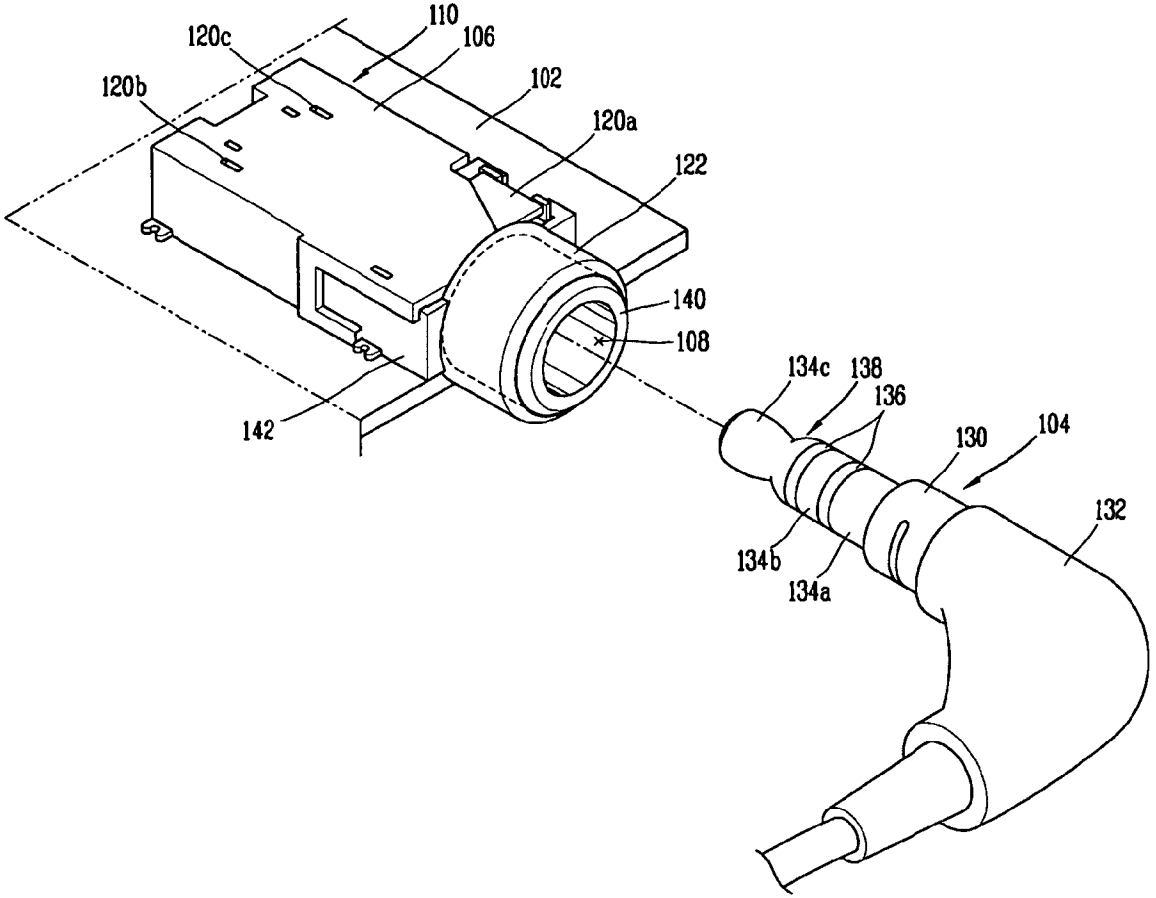
FIG. 1 RELATED ART
FIG. 1 is a perspective view of an external communication jack for a mobile terminal in accordance with the related art.
Figure 2:
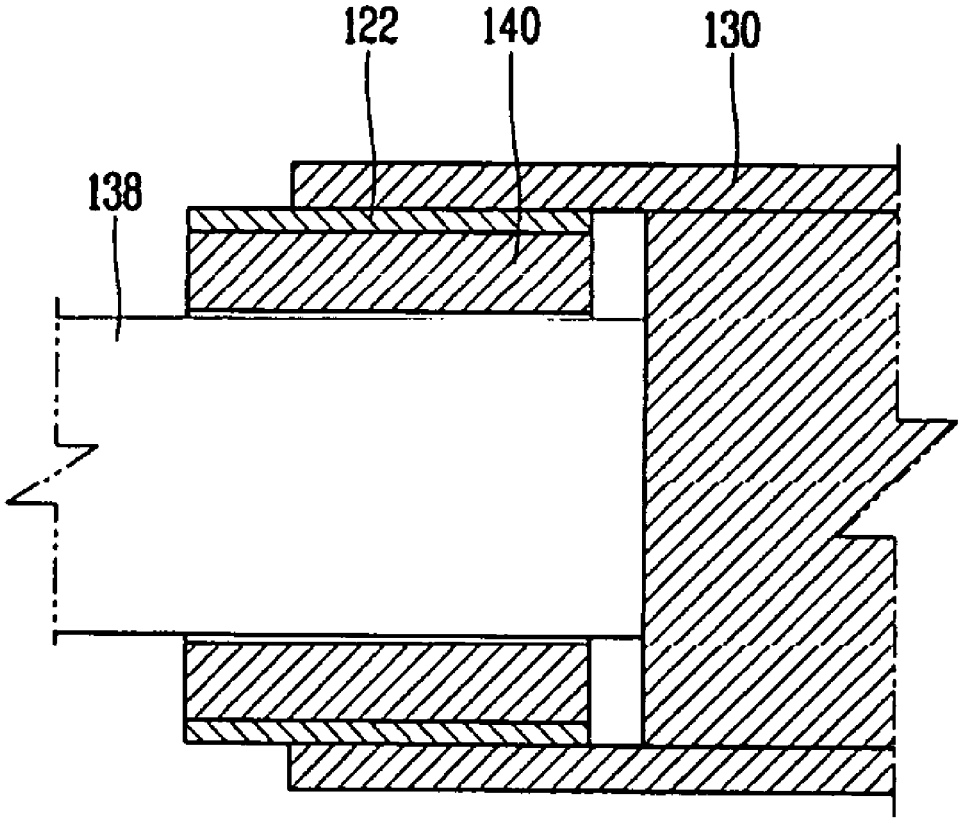
FIG. 2 RELATED ART
FIG. 2 is a partial sectional view illustrating a state where a plug of an earphone is insertedly positioned in the external communication jack in accordance with the related art.
Figure 3:
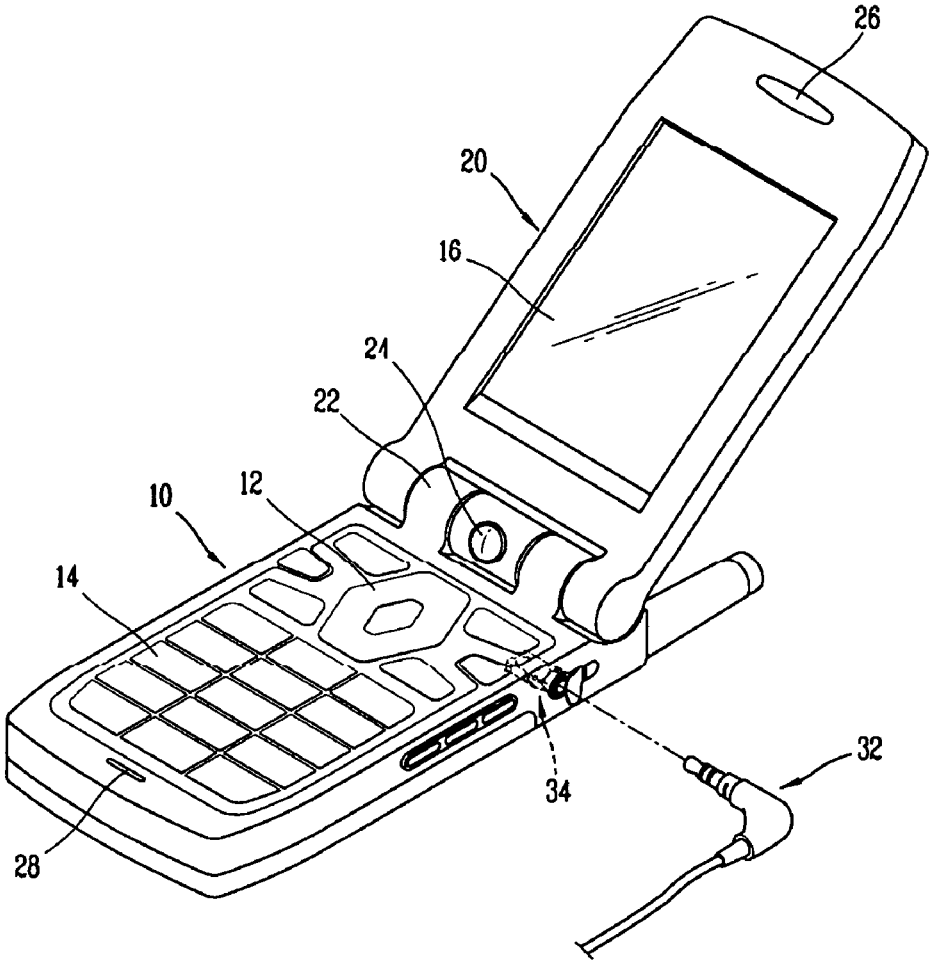
FIG. 3 is a perspective view of a mobile terminal with an external communication jack mounted therein in accordance with a first embodiment of the present invention.
Figure 4:
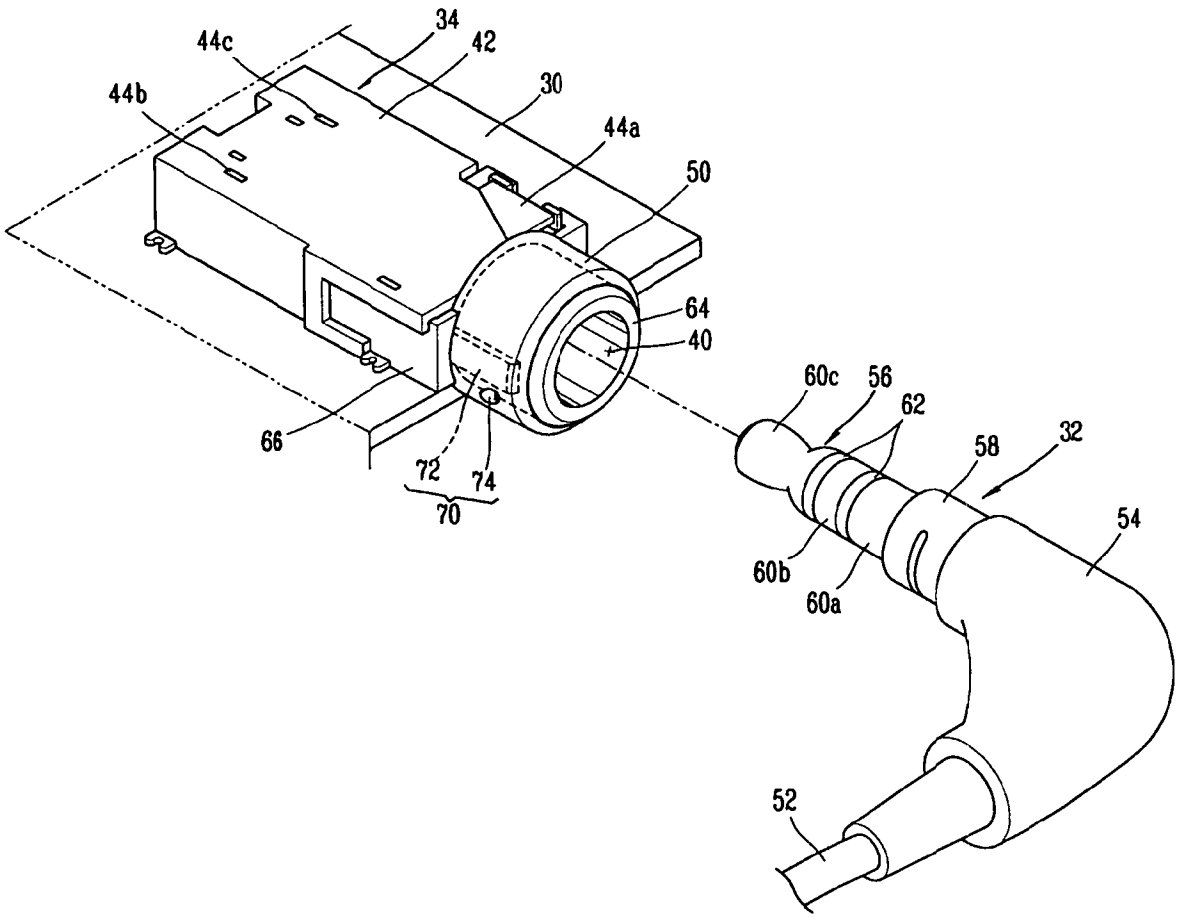
FIG. 4 is a perspective view of the external communication jack in accordance with the first embodiment of the present invention.

FIG. 3 is a perspective view of a mobile terminal with an external communication jack mounted therein in accordance with a first embodiment of the present invention. FIG. 4 is a perspective view of the external communication jack in accordance with the first embodiment of the present invention. Although the external communication jack of the present invention is described utilizing the mobile terminal of FIG. 3, for example, the present invention may be implemented in other types of mobile terminal devices having various structures.

As shown in FIG. 3, the mobile terminal in accordance with the present invention comprises a main body 10 having various menu buttons 12 and dial buttons 14 provided at its front surface, a folder 20 rotatably connected with the main body 10 and having a display 16, such as a liquid crystal display (LCD), for example, for displaying information desired by a user. The mobile terminal further comprises a hinge connection part 22 formed between the main body 10 and the folder 20 for rotatably supporting the folder 20 over the main body 10. A camera 24 may also be rotatably mounted at one side of the hinge connection part 22 for taking a photograph.

A receiver 26 for outputting a voice signal is mounted at an upper surface of the folder 20. A microphone 28 for inputting a voice signal is installed at one side of the main body 10. Referring to FIGS. 3 and 4, a printed circuit board (PCB) 30 having various circuit components for inputting and outputting various information mounted thereon is installed inside the main body 10. An external communication jack 34 is mounted at one side of the PCB 30, into which a plug 32 of an earphone or other device is inserted.

As shown in FIG. 4, the external communication jack 34 comprises a body 42 fixed at the PCB 30 and having an insertion passage 40 formed at its center, into which the plug 32 is inserted. Platy connection terminals 44*a*, 44*b* and 44*c* are mounted at the body 42 and connected to the PCB 30 by soldering or a similar bonding method for facilitating current flow. Preferably, the platy connection terminals 44*a*, 44*b* and 44*c* are sequentially mounted in the insertion passage 40. Moreover, a connection terminal 50 is mounted at an outer circumference of a front side of the body 42.

The plug 32 comprises a plug body 54 to which a power line 52 is connected and a bar type connection part 56 mounted at the plug body 54. The bar type connection part 56 is formed to be inserted into the insertion passage 40 of the body 42 and comprises first, second and third connection portions 60*a*, 60*b* and 60*c* formed at certain distances from each other. An insulation layer 62 is formed between the first connection part 60*a* and the second connection part 60*b*, as well as between the second connection part 60*b* and the third connection part 60*c*. The plug 32 further comprises an annular connection part 58 mounted at the plug body 54 and disposed with a certain distance at an outer circumferential surface of the bar type connection part 56.

A terminal mounting part 64, into which the bar type connection part 56 may be inserted, is preferably formed in a cylindrical shape at a front side of the body 42. However, it is contemplated that the terminal mounting part may be formed having any various shape, such as a rectangular or trapezoidal shape, for example, in order to accept a plug having the same various shape.

The platy connection terminals 44*a*, 44*b* and 44*c* are sequentially mounted inside the insertion passage 40 of the body 42. When the bar type connection part 56 is inserted into the terminal mounting part 64, the first platy connection terminal 44*a* contacts the first connection portion 60*a* of the plug 32, the second platy connection terminal 44*b* contacts the second connection portion 60*b*, and the third connection terminal 44*c* contacts the third connection portion 60*c*.

Preferably, the connection terminal 50 comprises an annular shape so as to be mounted at the outer circumferential surface of the terminal mounting part 64 of the body 42. However, the connection terminal 50 may have any various shape, such as an ellipse, rectangle, or triangle, for example, in accordance with any various shape the terminal mounting part 64 may have. A connection plate 66 is integrally formed at a rear side of the connection terminal 50.

One end of the connection plate 66 is integrally connected to the rear side of the connection terminal 50 while another end of the connection plate 66 is connected to the PCB 30 by soldering, for example, or any similar bonding method for facilitating current flow, and fixed to the body 42.

Between the connection terminal 50 and the terminal mounting unit 64, a rotation preventing part 70 is provided for preventing relative rotation of the connection terminal 50 over the terminal mounting part 64. A release preventing unit 76, as shown in FIG. 5, is also provided for preventing the release of the connection terminal 50 from the terminal mounting part 64.

Figure 5:
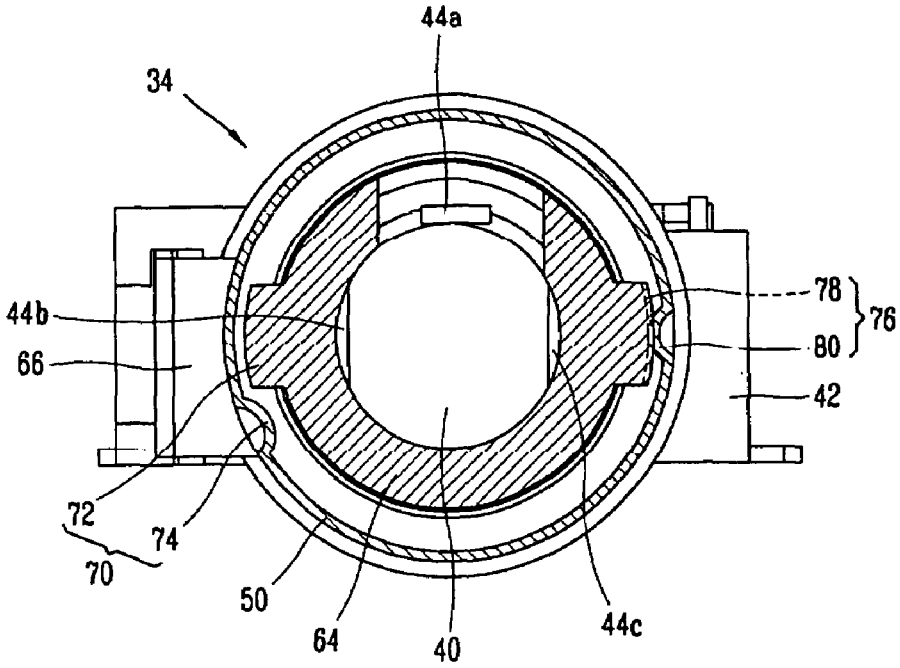
FIG. 5 is a sectional view of the external communication jack in accordance with the first embodiment of the present invention.

Referring to FIG. 5, the rotation preventing part 70 comprises a locking rib 72 protruded from the outer circumferential surface of the terminal mounting part 64 of the body 42 and a locking protrusion 74 protruded inwardly from an inner circumferential surface of the connection terminal 50. Preferably, in operation, the locking protrusion 74 is caught at a side of the locking rib 72 to prevent movement of the connection terminal 50.

Preferably, the locking rib 72 outwardly protrudes with a certain width in an axial direction from the outer circumferential surface of the terminal mounting part 64, and the locking protrusion 75 inwardly protrudes from the connection terminal 50 and may be caught at one side of the locking rib 74.

Preferably, the locking protrusion 72 is caught at one side of the locking rib 74 to prevent rotation of the connection terminal 50 in one direction. Thus, the rotation preventing part 70 locks the connection terminal 50 from possibly rotating in one direction. Accordingly, damage to the soldered portion between the connection plate 66 and the PCB 30 that may have been caused by a rotational moment generated at the connection terminal 50 is prevented.

While FIG. 5 illustrates one embodiment for a rotation preventing part of the present invention, the rotation preventing part of the present invention may embody any other structure so long as it prevents rotation of the annular connection terminal.

Figure 6:
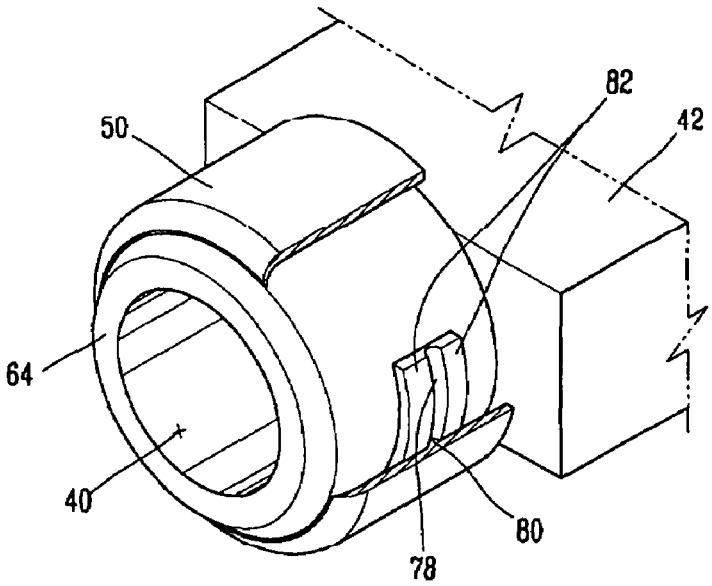
FIG. 6 is a perspective view of a release preventing part of the external communication jack in accordance with the first embodiment of the present invention.

Referring to FIG. 6, the release preventing unit 76 comprises a locking groove 78 formed in a circumferential direction on the outer circumferential surface of the terminal mounting part 64 and a locking protrusion 80 protruded inwardly from the inner circumferential surface of the connection terminal 50. Preferably, the locking protrusion 80 may be caught in the locking groove 78 to prevent movement of the connection terminal 50.

Preferably, the locking groove 78 is formed between two protrusion parts 82, formed in the circumferential direction and having a certain distance therebetween at the outer circumferential surface of the terminal mounting part 64.

In operation, the locking protrusion 80 is inserted into the locking groove 78 to prevent the connection terminal 50 from moving in the axial direction with respect to the terminal mounting part 64. Accordingly, release of the connection terminal 50 from the terminal mounting part 64 is prevented.

The preferred operation of the external communication jack in accordance with the present invention will now be described.

When the plug 32 is mounted in the external communication jack 34, the bar-type connection part 56 of the plug 32 is inserted into the insertion passage 40 of the body 42. Moreover, the annular connection part 58 is mounted at the outer circumferential surface of the connection terminal 50.

Accordingly, the first connection portion 60*a* of the bar-type connection part 56 contacts the first connection terminal 44*a* formed inside the insertion passage 40, the second connection portion 60*b* contacts the second connection terminal 44*b*, the third connection portion 60*c* contacts the third connection terminal 44*c*, and the annular connection part 58 is mounted at the outer circumferential surface of the connection terminal 50. Therefore, an electrical signal of the mobile terminal may be transmitted through the plug to the earphone or other device or an electrical signal of the earphone or other device may be transmitted through the plug to the mobile terminal.

In this state, when the plug 32 is rotated, the annular connection part 58 is also rotated while being mounted at the connection terminal 50. However, because the connection terminal 50 is locked at the terminal mounting part 64 by the rotation preventing part 70, rotation of the connection terminal 50 is prevented. Therefore, damage to the soldered portion between the connection plate 66 and the PCB 30 that may have been caused by rotation of the connection terminal 50 is prevented.

Figure 7:
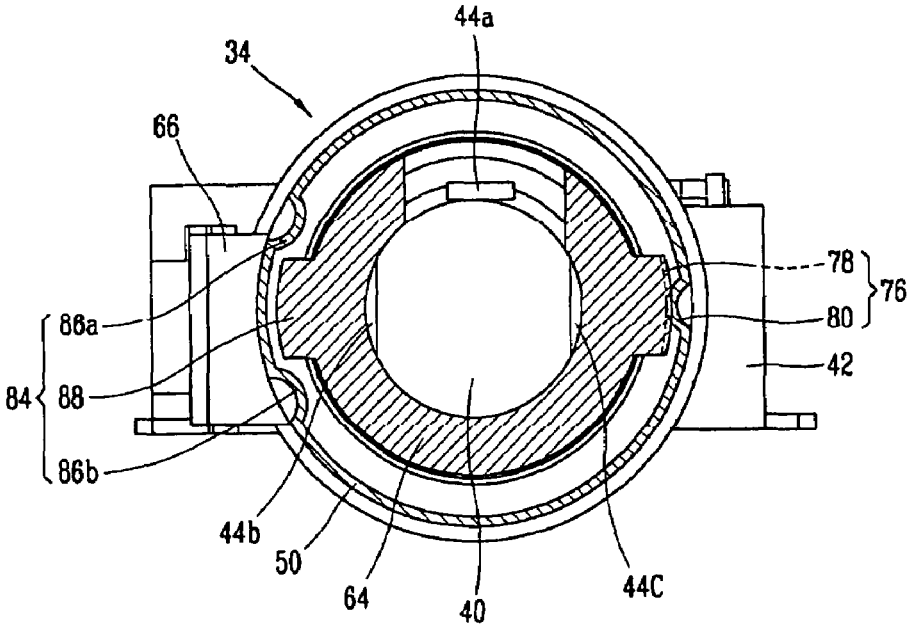
FIG. 7 is a sectional view of a rotation preventing part of the external communication jack in accordance with a second embodiment of the present invention.

FIG. 7 is a sectional view of a rotation preventing part of the external communication jack in accordance with a second embodiment of the present invention.

A rotation preventing part 84 in accordance with the second embodiment of the present invention is used to prevent rotation of the connection terminal 50 in a clockwise or counterclockwise direction. The rotation preventing part 84 comprises a locking rib 88 protruded in an axial direction from an outer circumferential surface of the terminal mounting part 64 of the body 42 and a pair of locking protrusions 86*a* and 86*b* inwardly protruding from an inner circumferential surface of the connection terminal 50. Preferably, the locking protrusions 86*a* and 86*b* are formed with a certain distance between them and may be caught at both sides of the locking rib 88 to prevent movement of the connection terminal 50 when in operation.

Specifically, because the locking protrusions 86*a* and 86*b* may be caught at both sides of the locking rib 88, the connection terminal 50 is prevented from being rotated in the clockwise or counterclockwise direction when the plug 32 is inserted into the terminal mounting part 64.

Figure 8:
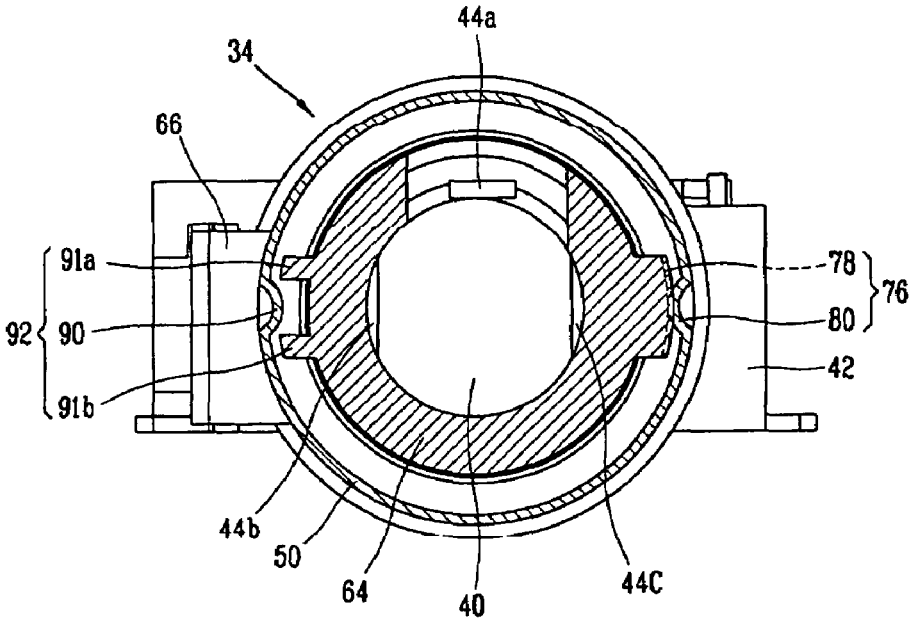
FIG. 8 is a sectional view of a rotation preventing part of the external communication jack in accordance with a third embodiment of the present invention.

FIG. 8 is a sectional view of a rotation preventing part of the external communication jack in accordance with a third embodiment of the present invention.

A rotation preventing part 92 in accordance with the third embodiment of the present invention comprises a pair of locking ribs 91*a* and 91*b* protruding in an axial direction from an outer circumferential surface of the terminal mounting part 64. Preferably, the locking ribs 91*a* and 91*b* have a certain distance between them. The rotation preventing part 92 further comprises a locking protrusion 90 protruded inwardly from an inner circumferential surface of the connection terminal 50. In operation, when the plug 32 is inserted into the terminal mounting part 64, the locking protrusion 90 may be disposed between the locking ribs 91*a* and 91*b*.

Accordingly, the locking protrusion 90 is caught between the pair of locking ribs 91*a* and 91*b*. Thus, the connection terminal 50 is prevented from being rotated in the clockwise and counterclockwise direction.

Figure 9:
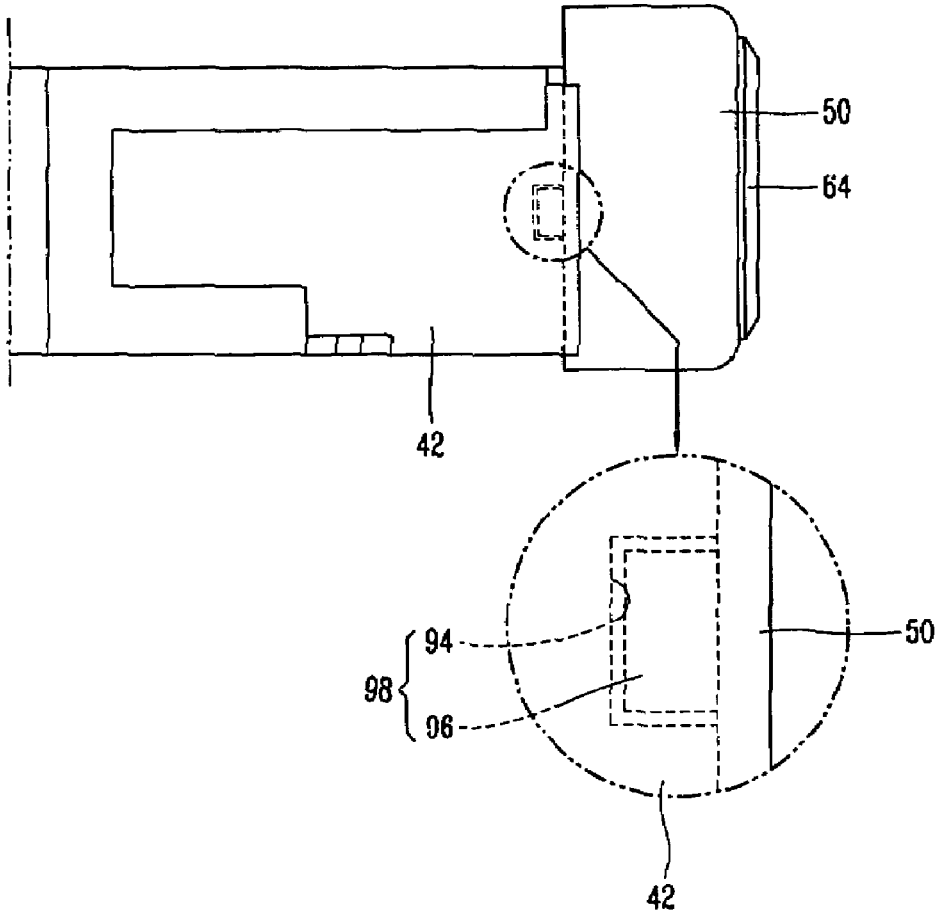
FIG. 9 is a side view of a rotation preventing part of the external communication jack in accordance with a fourth embodiment of the present invention.

FIG. 9 is a side view of a rotation preventing part of the external communication jack in accordance with a fourth embodiment of the present invention.

A rotation preventing part 98 in accordance with the fourth embodiment of the present invention comprises a stopping protrusion 96 extended in an axial direction from an end portion of a rear side of the connection terminal 50 and a stopping recess 94 formed in a longitudinal direction at the body 42, into which the stopping protrusion 96 is inserted to be caught.

Accordingly, when the stopping protrusion 96 formed at the connection terminal 50 is inserted into the stopping recess 94 formed at the body 42, rotation of the annular connection terminal 94 that may be caused by the insertion of the plug 32 into the terminal mounting part 64, is prevented.

Figure 10:
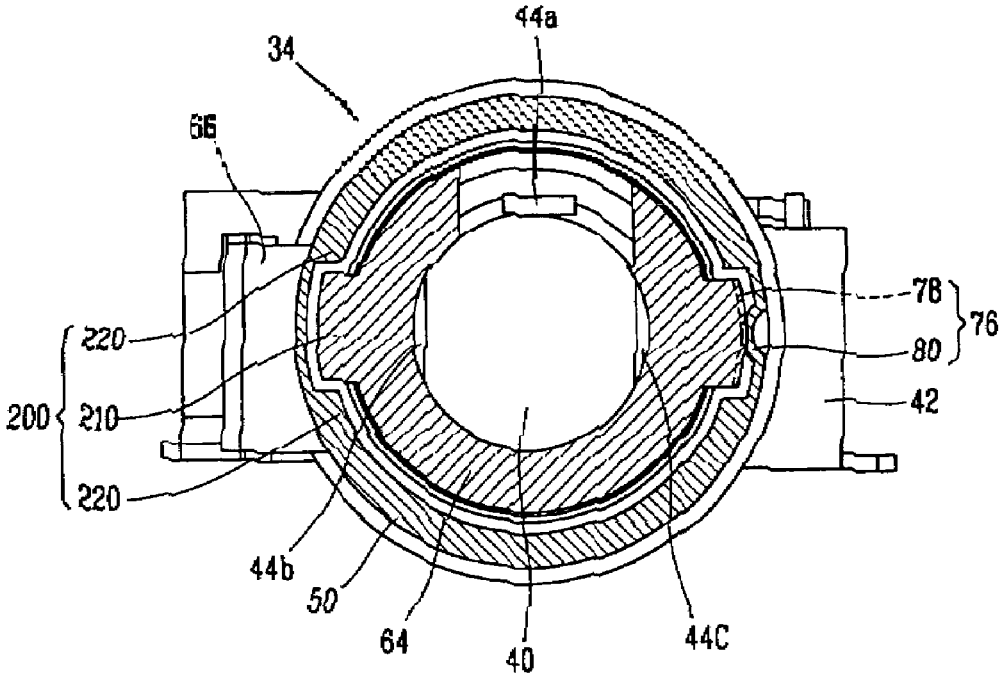
FIG. 10 is a sectional view of a rotation preventing part of the external communication jack in accordance with a fifth embodiment of the present invention.

FIG. 10 is a sectional view of a rotation preventing part of the external communication jack in accordance with a fifth embodiment of the present invention.

A rotation preventing part 200 in accordance with the fifth embodiment of the present invention comprises a locking protrusion 210 protruding in an axial direction from an outer circumferential surface of the terminal mounting part 64. The rotation preventing part 200 further comprises a locking recess 220 formed in an inner circumferential surface of the connection terminal 50. In operation, when the plug 32 is inserted into the terminal mounting part 64, the locking protrusion 210 is disposed in the locking recess 220.

Accordingly, the locking protrusion 210 is caught in the locking recess 220. Thus, the connection terminal 50 is prevented from being rotated in the clockwise and counterclockwise direction.

As so far described, the external communication jack in accordance with the present invention has the following advantages.

For example, because the rotation preventing part is formed between the terminal mounting part of the body and the annular connection terminal, rotation of the annular connection terminal is prevented. That is, when the annular connection part of the plug is rotated while being mounted at the annular connection terminal, the annular connection terminal is locked in place by the rotation preventing part. Therefore, rotation of the annular connection terminal is prevented, thereby preventing damage to the external communication jack.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An external communication jack for a terminal, the external communication jack comprising:

a body having an insertion passage for accepting a plug;

a terminal mounting part formed on the body for mounting the plug;

a connection terminal formed at an outer surface of the terminal mounting part and operatively coupled to circuitry for operating the terminal;

a rotation preventing part formed on at least one of an outer surface of the terminal mounting part and an inner surface of the connection terminal, wherein the rotation preventing part at least partially prevents rotation of the connection terminal with respect to the terminal mounting part; and a release preventing unit operating between the connection terminal and the terminal mounting part for preventing axial movement of the connection terminal with respect to the terminal mounting part, wherein the release preventing unit comprises a locking groove formed in a rotational direction on an outer surface of the terminal mounting part and a locking protrusion protruding from an inner surface of the connection terminal, wherein the locking protrusion operatively engages the locking groove to prevent the axial movement of the connection terminal.

2. The external communication jack of claim 1, wherein the rotation preventing part comprises:

a first rotation preventing part formed on the outer surface of the terminal mounting part; and a second rotation preventing part formed on the inner surface of the connection terminal;

wherein the first rotation preventing part and the second rotation preventing part engage one another to prevent rotation of the connection terminal with respect to the terminal mounting part.

3. The external communication jack of claim 2, wherein:

the first rotation preventing part is a locking rib protruding from an outer surface of the terminal mounting part; and the second rotation preventing part is a locking protrusion protruding from an inner surface of die connection terminal, wherein the locking rib operatively engages the locking protrusion to prevent rotation of the connection terminal.

4. The external communication jack of claim 2, wherein:

the first rotation preventing part is a locking rib protruding from an outer surface of the terminal mounting part; and the second rotation preventing part is a pair of locking protrusions protruding from an inner surface of the connection terminal, wherein the locking rib operatively engages either of the pair of locking protrusions to prevent rotation of the connection terminal in at least one of a clockwise and counterclockwise direction.

5. The external communication jack of claim 2, wherein:

the first rotation preventing part is a pair of locking ribs protruding from an outer surface of the terminal mounting part; and the second rotation preventing part is a locking protrusion protruding from an inner surface of the connection terminal, wherein each of the pair of locking ribs operatively engages the locking protrusion respectively to prevent rotation of the connection terminal in at least one a clockwise and counterclockwise direction.

6. The external communication jack of claim 2, wherein:

the first rotation preventing part is a locking rib protruding from an outer surface of the terminal mounting part; and the second rotation preventing part is a locking recess formed in an inner surface of the connection terminal, wherein the locking rib inserts into the locking recess to prevent rotation of the connection terminal.

7. The external communication jack of claim 1, wherein the locking groove is formed by two protrusion portions formed in a rotational direction on the outer surface of the terminal mounting part and having a certain distance therebetween.

8. The external communication jack of claim 1, wherein the insertion passage houses at least one connection terminal for contacting a connection on part of the plug.

9. An external communication jack for a terminal, the external communication jack comprising:

a body having an insertion passage for accepting a plug;

a terminal mounting part formed on the body for mounting the plug;

a connection terminal formed at an outer surface of the terminal mounting part and operatively coupled to circuitry for operating the terminal;

a rotation preventing part formed on the body and the connection terminal for at least partially preventing rotation of the connection terminal with respect to the terminal mounting part; and a release preventing unit operating between the connection terminal and the terminal mounting part for preventing axial movement of the connection terminal with respect to the terminal mounting part, wherein the release preventing unit comprises a locking groove formed in a rotational direction on an outer surface of the terminal mounting part and a locking protrusion protruding from an inner surface of the connection terminal, wherein the locking protrusion operatively engages the locking groove to prevent the axial movement of the connection terminal.

10. The external communication jack of claim 9, wherein the rotation preventing part comprises:

a stopping protrusion extending from a rear side of the connection terminal; and a stopping recess formed in a longitudinal direction at the body, wherein the stopping protrusion is operatively inserted into the stopping protrusion to prevent rotation of the connection terminal.

11. A mobile terminal for accepting a plug, the mobile terminal comprising:

a main body;

circuitry housed within the main body for operating the mobile terminal; and an external communication jack operatively connected to the circuitry, wherein the external communication jack comprises:

a body having an insertion passage for accepting the plug;

a terminal mounting part formed on the body for mounting the plug;

a connection terminal formed at an outer surface of the terminal mounting part and operatively coupled to the circuitry for operating the mobile terminal;

a rotation preventing part formed on at least one of an outer surface of the terminal mounting part and an inner surface of the connection terminal, wherein the rotation preventing part at least partially prevents rotation of the connection terminal with respect to the terminal mounting part; and a release preventing unit operating between the connection terminal and the terminal mounting part for preventing axial movement of the connection terminal with respect to the terminal mounting part, wherein the release preventing unit comprises a locking groove formed in a rotational direction on an outer surface of the terminal mounting part and a locking protusion protruding from an inner surface of the connection terminal, wherein the locking protrusion operatively engages the locking groove to prevent the axial movement of the connection terminal.

12. The mobile terminal of claim 11, wherein the rotation preventing part comprises:

a first rotation preventing part formed on the outer surface of the terminal mounting part; and a second rotation preventing part formed on the inner surface of the connection terminal;

wherein the first rotation preventing part and the second rotation preventing part engage one another to prevent rotation of the connection terminal with respect to the terminal mounting part.

13. The mobile terminal of claim 12, wherein:

the first rotation preventing part is a locking rib protruding from an outer surface of the terminal mounting part; and the second rotation preventing part is a locking protrusion protruding from an inner surface of the connection terminal, wherein the locking rib operatively engages the locking protrusion to prevent rotation of the connection terminal.

14. The mobile terminal of claim 12, wherein:

the first rotation preventing part is a locking rib protruding from an outer surface of the terminal mounting part; and the second rotation preventing part is a pair of locking protrusions protruding from an inner surface of the connection terminal, wherein the locking rib operatively engages either of the pair of locking protrusions to prevent rotation of the connection terminal in at least one of a clockwise and counterclockwise direction.

15. The mobile terminal of claim 12, wherein:

the first rotation preventing part is a pair of locking ribs protruding from an outer surface of the terminal mounting part; and the second rotation preventing part is a locking protrusion protruding from an inner surface of the connection terminal, wherein each of the pair of locking ribs operatively engages the locking protrusion respectively to prevent rotation of the connection terminal in at least one a clockwise and counterclockwise direction.

16. The mobile terminal of claim 12, wherein:

the first rotation preventing part is a locking rib protruding from an outer surface of the terminal mounting part; and the second rotation preventing part is a locking recess formed in an inner surface of the connection terminal, wherein the locking rib inserts into the locking recess to prevent rotation of the connection terminal.

17. The mobile terminal of claim 11, wherein the locking groove is formed by two protrusion portions formed in a rotational direction on the outer surface of the terminal mounting part and having a certain distance therebetween.

18. The mobile terminal of claim 11, wherein the insertion passage houses at least one connection terminal for contacting a connection part of the plug.

19. A mobile terminal for accepting a plug, the mobile terminal comprising:

a main body;

circuitry housed within the main body for operating the mobile terminal; and an external communication lack operatively connected to the circuitry, wherein the external communication jack comprises:

a body having an insertion passage for accepting the plug;

a terminal mounting part formed on the body for mounting the plug;

a connection terminal formed at an outer surface of the terminal mounting part and operatively coupled to the circuitry for operating the mobile terminal;

a rotation preventing part formed on the body and the connection terminal for at least partially preventing rotation of the connection terminal with respect to the terminal mounting part; and a release preventing unit operating between the connection terminal and the terminal mounting part for preventing axial movement of the connection terminal with respect to the terminal mounting part, wherein the release preventing unit comprises a locking groove formed in a rotational direction on an outer surface of the terminal mounting part and a locking protrusion protruding from an inner surface of the connection terminal, wherein the locking protrusion operatively engages die locking groove to prevent the axial movement of the connection terminal.

20. The mobile terminal of claim 19, wherein the rotation preventing part comprises:

a stopping protrusion extending from a rear side of the connection terminal; and a stopping recess formed in a longitudinal direction at the body, wherein the stopping protrusion is operatively inserted into the stopping protrusion to prevent rotation of the connection terminal.

* * * * *